US005180152A

United States Patent [19]

Irie

[11] Patent Number: 5,180,152

[45] Date of Patent: Jan. 19, 1993

[54] SORTER

[75] Inventor: Yoichiro Irie, Suita, Japan

[73] Assignee: Mita Industrial Co., Ltd., Osaka, Japan

[21] Appl. No.: 788,877

[22] Filed: Nov. 7, 1991

[30] Foreign Application Priority Data

Nov. 15, 1990 [JP] Japan ..... 2-307136

[51] Int. Cl.[5] ..... B42B 2/00; B65H 39/02

[52] U.S. Cl. ..... 270/53; 270/58; 271/292; 271/293

[58] Field of Search ..... 270/52, 53, 58, 37; 271/292, 293, 294

[56] References Cited

U.S. PATENT DOCUMENTS

| | | | |
|---|---|---|---|
| 4,762,312 | 8/1988 | Ushirogata | 270/53 |
| 4,878,660 | 11/1989 | Irie | 271/293 |
| 4,898,372 | 2/1990 | Hirabayashi et al. | 270/53 |
| 4,930,761 | 6/1990 | Naito et al. | 270/53 |
| 5,048,820 | 9/1991 | Chung et al. | 271/293 |
| 5,088,709 | 2/1992 | Yamamoto | 270/52 X |

FOREIGN PATENT DOCUMENTS

| | | |
|---|---|---|
| 0425988 | 5/1991 | European Pat. Off. . |
| 0439032 | 7/1991 | European Pat. Off. . |
| 0465761 | 1/1992 | European Pat. Off. . |
| 57-166266 | 10/1982 | Japan . |

OTHER PUBLICATIONS

Patent Abstracts of Japan, vol. 14, No. 393—Aug. 24, 1990.

*Primary Examiner*—Edward K. Look
*Assistant Examiner*—John Ryznic
*Attorney, Agent, or Firm*—Beveridge, DeGrandi, Weilacher & Young

[57] ABSTRACT

A sorter comprising a plurality of vertically arranged bin trays. Each of the bin trays is moved through a predetermined moving passage, and the moving passage includes a main portion and a by-pass caused to detour from the main portion to the upstream or downstream side. The sorter also has an automatic stapler and an automatic punch. When the bin tray and sheets collected thereon are positioned in the by-pass end portion of the by-pass, the sheets are positioned at a stapling position relative to the automatic stapler, and the sheets are positioned at an automatically punching position relative to the automatic punch.

4 Claims, 12 Drawing Sheets

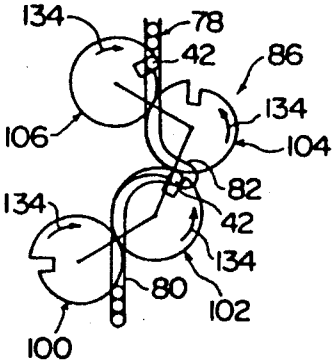
Fig. 6—A
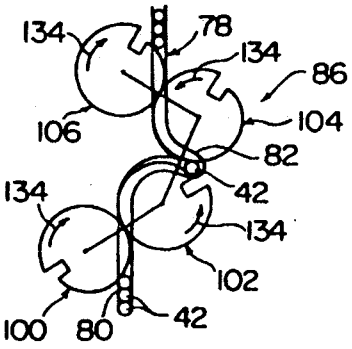
Fig. 6—B
Fig. 6—C
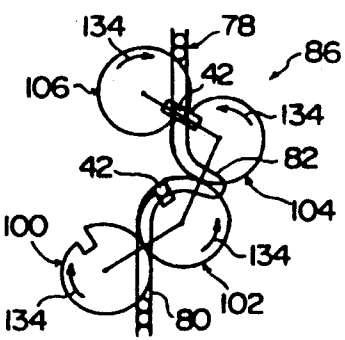
Fig. 6—D
Fig. 6—E
Fig. 6—F

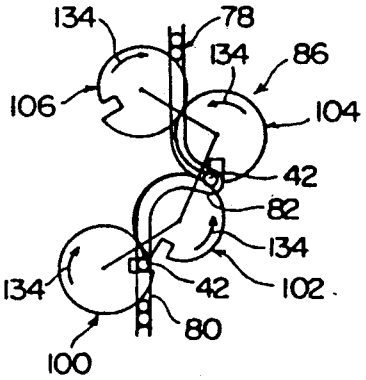
Fig. 6—I
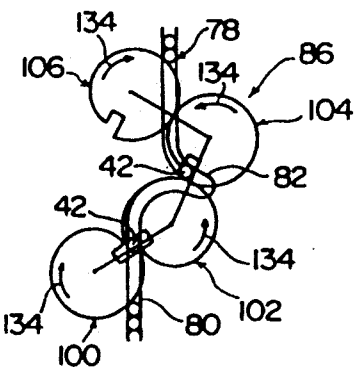
Fig. 6—H
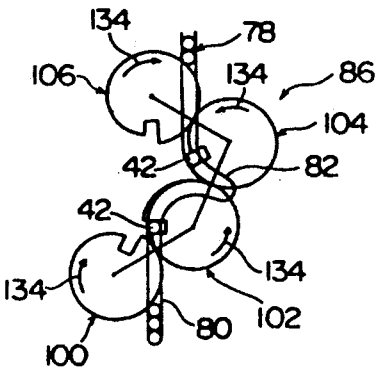
Fig. 6—G
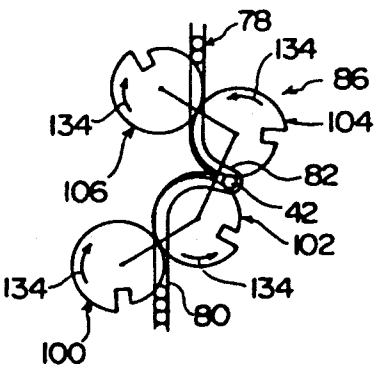
Fig. 6—L
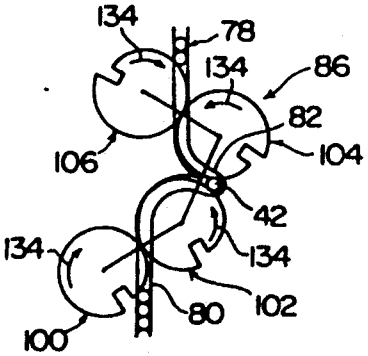
Fig. 6—K
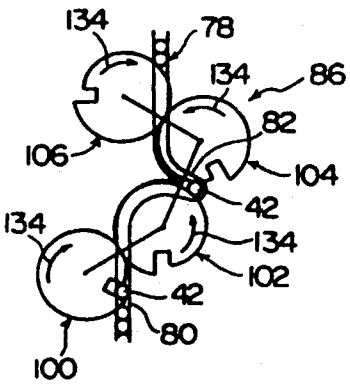
Fig. 6—J Fig. 9 – A
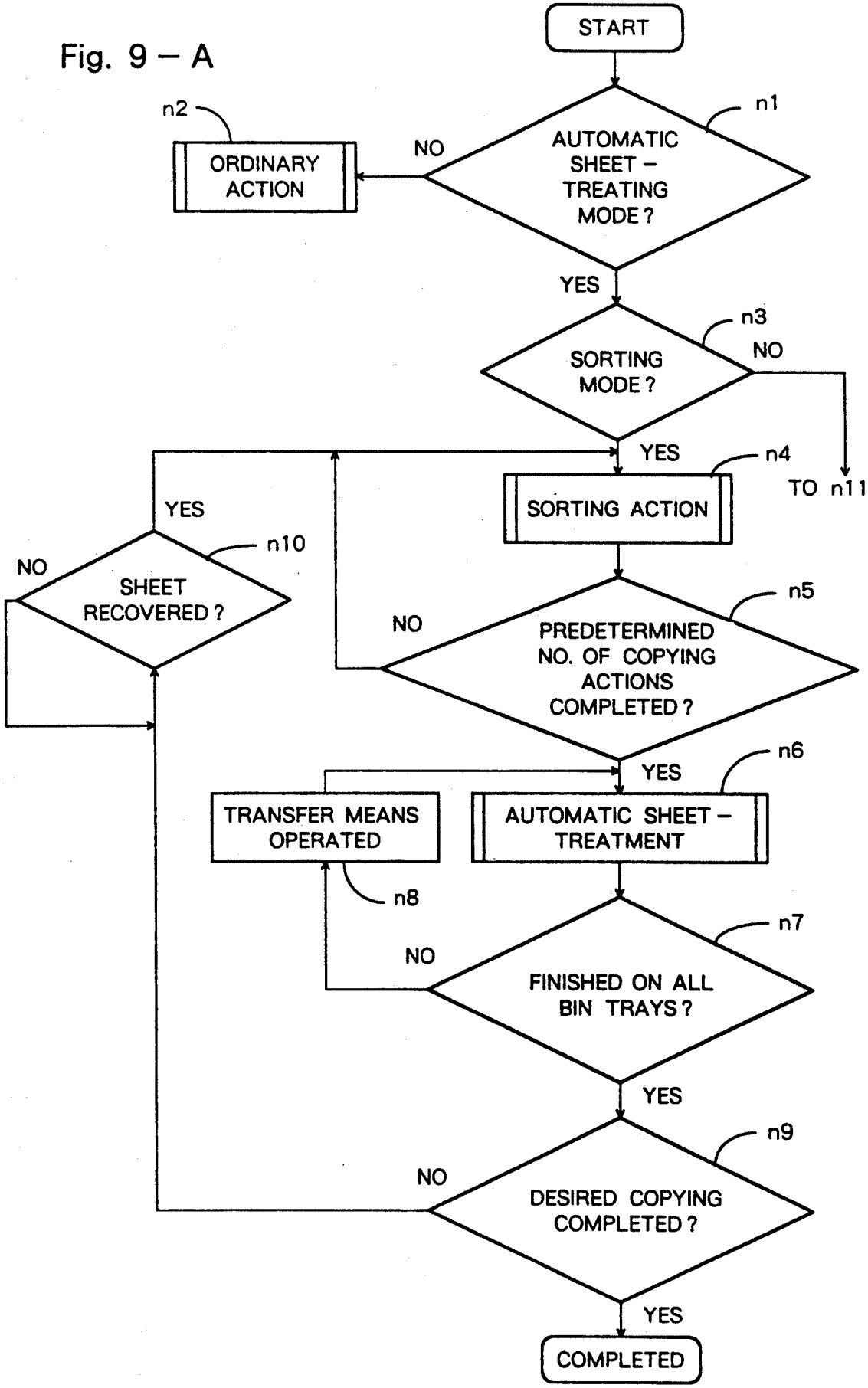

Fig. 9 – B
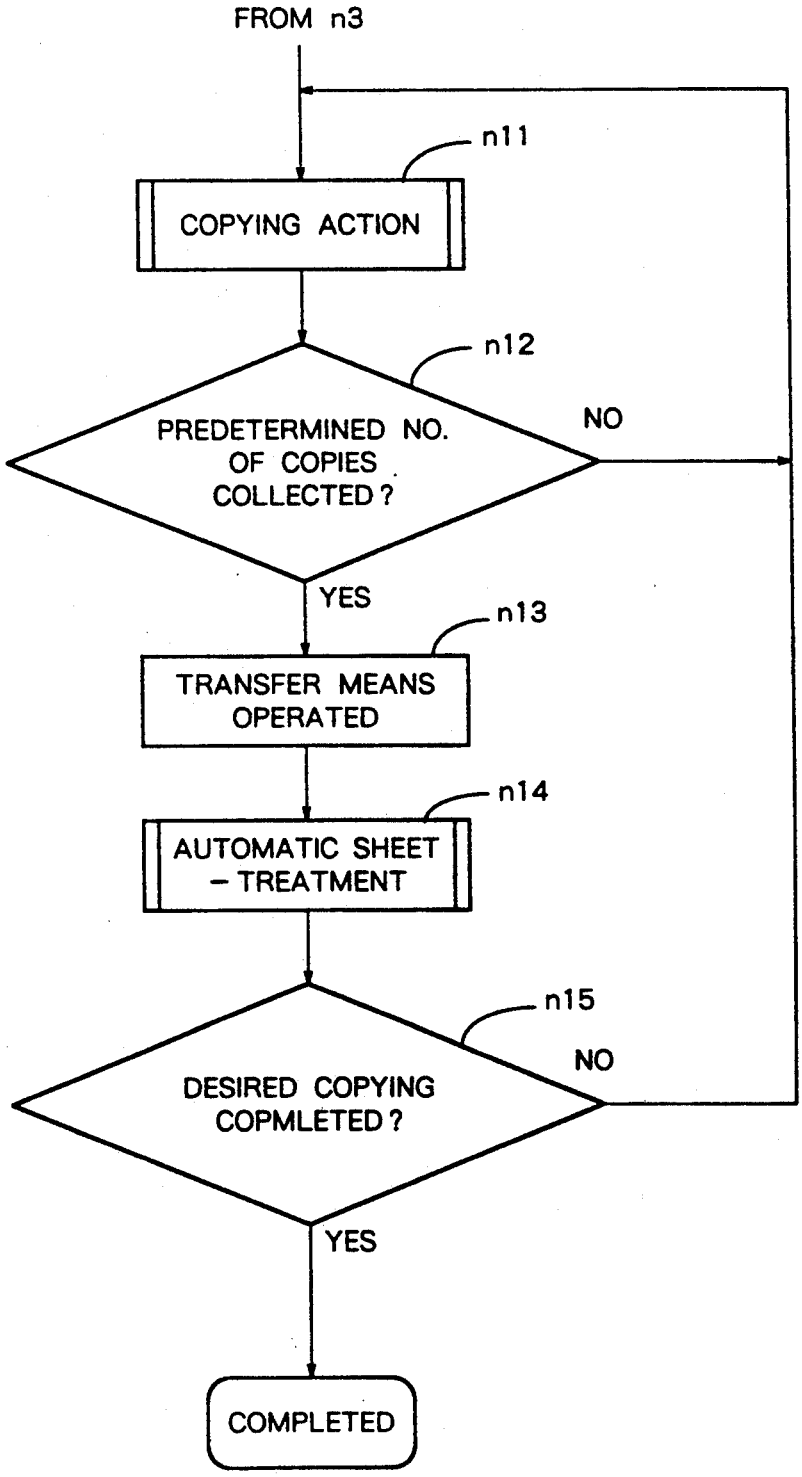

SORTER

FIELD OF THE INVENTION

This invention relates to a sorter for use in a copying machine, a printer or the like, and more specifically, to a sorter in which a plurality of vertically arranged bin trays are moved successively one by one and the adjacent bin trays are separated successively from each other vertically at their upstream ends to form a sheet receiving opening.

DESCRIPTION OF THE PRIOR ART

Relatively small-sized "compact" sorters which receive sheets, discharged from a copying machine, a printer or the like, in a sorted state as required have been proposed and come into commercial acceptance. The prior art disclosing the compact sorters typically consists of, for example, U.S. Pat. No. 4,328,963 (Japanese Laid-Open Patent Publication No. 78770/1981), U.S. Pat. No. 4,337,936 (Japanese Laid-Open Patent Publication No. 4856/1982), or U.S. Pat. No. 4,878,660 (Japanese Laid-Open Patent Publication No. 34865/1989).

The compact sorter is provided with a plurality of vertically arranged bin trays, and a transfer mechanism for moving the bin trays. The transfer mechanism moves the bin trays successively one by one and separates the adjacent bin trays successively from each other vertically at their upstream ends to form a sheet receiving opening.

Furthermore, Japanese Laid-Open Patent Publication No. 231756/1989, 287663/1986 or 285866/1987 discloses a sorter equipped with an automatic stapler for automatically fastening together a plurality of stacked sheets collected on the bin tray.

The conventional sorters, however, have the following problems to be solved.

The sorter with the automatic stapler requires, in stapling a plurality of stacked sheets on the bin tray, that the automatic stapler should move from a non-operating position to a required stapling position, and after performing a stapling action, return to the non-operating position. Therefore, a construction for the automatic stapler, especially, a construction for a means of moving the automatic stapler, is relatively complicated and expensive, and in addition, takes a relatively long time for the stapling operation.

In addition to, or instead of, the stapling of a plurality of stacked sheets collected on the bin tray, it is also desired, not rarely, to punch the plural stacked sheets. The conventional sorter is not provided with an automatic punch capable of automatically performing punching, and cannot fulfill this need.

SUMMARY OF THE INVENTION

It is an object of this invention to provide a sorter equipped with a means for automatically treating sheets, such as an automatic stapler or an automatic punch, said sorter being simple in construction and being manufacturable for a low price, as compared with the conventional sorter provided with an automatic stapler.

Another object of this invention is to provide a sorter capable of applying required treatments, such as stapling or punching, to a plurality of sheets collected on bin trays, substantially without requiring a particular treating time in addition to the time necessary for a usual sorting action.

Still another object of the invention is to provide a sorter equipped with an automatic punch in addition to, or instead of, an automatic stapler.

In a sorter constructed according to one aspect of this invention, a moving passage for each of bin trays includes a main portion and a by-pass to detour from the main portion to the upstream or downstream side. The bin tray and sheets collected thereon are caused to move along the main portion and the by-pass without undergoing interference by an automatic sheet-treating means such as an automatic stapler or an automatic punch. When the bin tray and the sheets collected thereon are positioned at the by-pass end portion of the by-pass, the sheets collected on the bin tray are positioned at a required treating position relative to the automatic sheet-treating means.

This sorter has conveniently the following constructions.

Each of the bin trays has a widthwise projecting trunnion in at least one side thereof, and when the trunnions are each moved along the predetermined moving passage, the bin trays are each moved in a predetermined manner. It is also convenient that a transfer mechanism includes a plurality of vertically arranged rotating cam plates. At least the uppermost and lowermost rotating cam plates each have a trunnion receiving groove extending radially and being open at its radially outside end and an outer circumferential cam surface extending continuously in the circumferential direction excepting a site corresponding to the trunnion receiving groove. The outer circumferential cam surface is a convoluted surface whose radius increases progressively in a given rotating direction.

Preferably, an automatic punch is disposed in addition to an automatic stapler. When the bin tray and sheets collected thereon are positioned at the by-pass end portion, the sheets collected on the bin tray are positioned at a stapling position relative to the automatic stapler and also at an automatically punching position relative to the automatic punch.

In the sorter constructed in accordance with the aspect of this invention, sheets collected on the bin tray are positioned at a required treating position relative to the automatic sheet-treating means such as an automatic stapler or automatic punch as a result of the movement of the bin trays designed for the usual sorting action. Accordingly, there is no need to move the automatic treating means relative to the sheets collected on the bin tray. Hence, the construction for the automatic sheet-treating means such as the automatic stapler or automatic punch can be made markedly simple and inexpensive as compared with the conventional sorter provided with an automatic stapler. Furthermore, a required treatment such as stapling or punching can be applied to the sheets collected on the bin tray, without any particular treating time being required in addition to the necessary time for the usual sorting action. In case an automatic punch is provided in addition to, or instead of, an automatic stapler, the sheets collected on the bin tray can undergo punching as desired.

BRIEF DESCRIPTION OF THE DRAWINGS

FIGS. 6-A to 6-L are simplified side views for illustrating the actions of the transfer means in the sorter of FIG. 1.

FIGS. 9A, 9B, 10 and 11 are flow charts for illustrating the actions of the sorter of FIG. 1.

DETAILED DESCRIPTION OF PREFERRED EMBODIMENTS

With reference to the accompanying drawings, the preferred embodiments of the sorter constructed in accordance with this invention will be described in detail.

Figure 1:
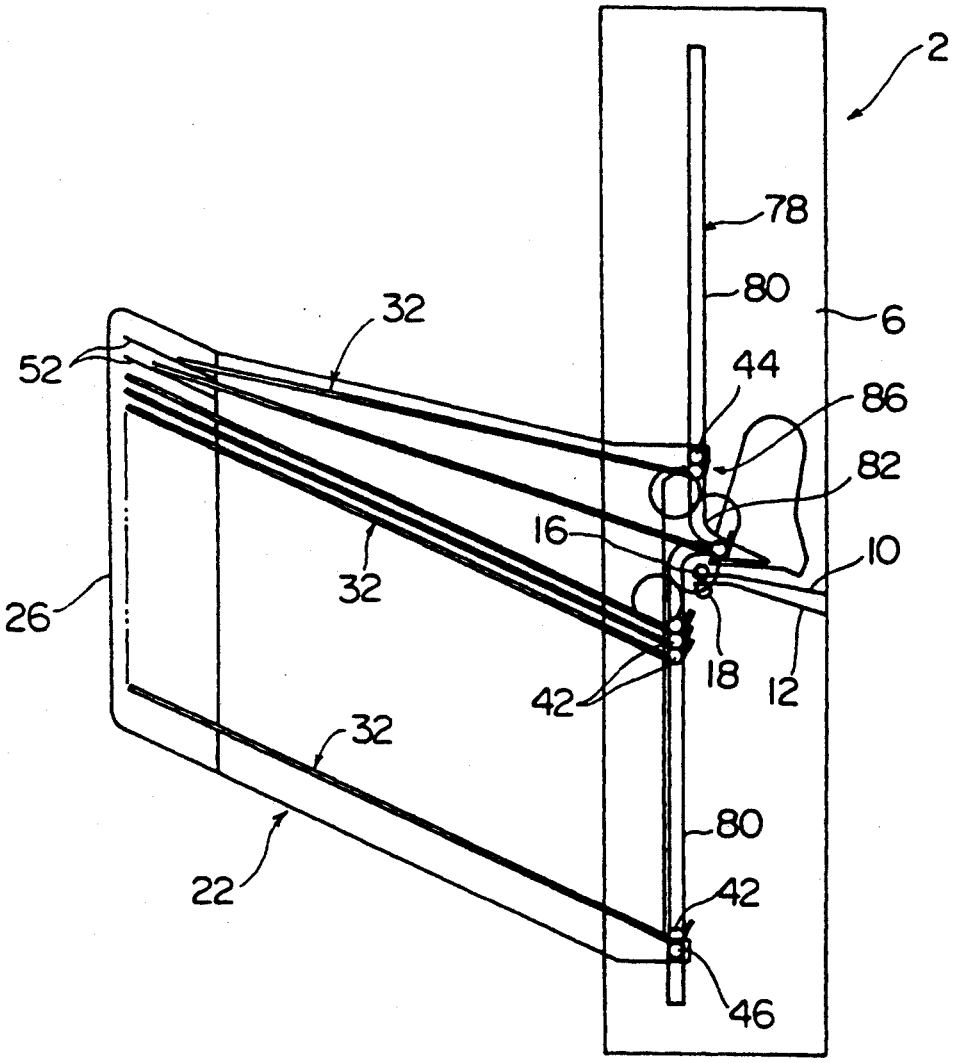
FIG. 1 is a simplified side view showing an embodiment of a sorter constructed in accordance with this invention.
Figure 2:
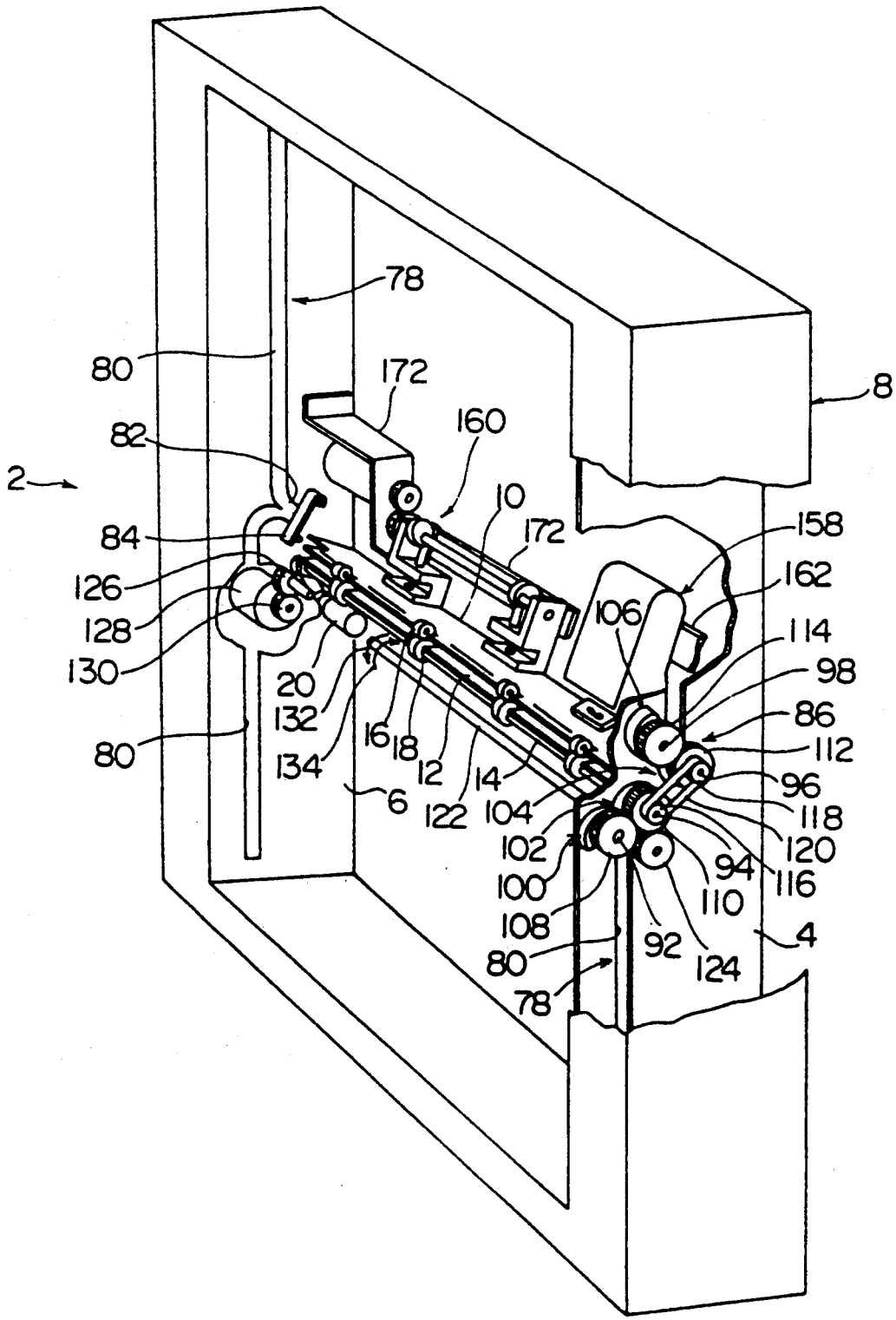
FIG. 2 is a partial perspective view showing a stationary supporting frame and various constituent elements mounted thereon, in the sorter of FIG. 1.

With reference to FIGS. 1 and 2, the illustrated sorter is provided with a stationary supporting frame 2. The stationary supporting frame 2 is rectangular on the whole. It includes a front upstanding supporting side plate 4 and a rear upstanding supporting side plate 6 which are disposed at a predetermined distance therebetween in the width direction, and a cover member 8 covering these supporting side plates 4 and 6. Between the supporting side plates 4 and 6 are mounted an upper guide plate 10 and a lower guide plate 12, with some distance being provided therebetween in the vertical direction. Between the supporting side plates 4 and 6 are further rotatably mounted an upper follower shaft (not shown) and a lower driven shaft 14 (FIG. 2) which extend widthwise along the downstream end portions of the guide plates 10 and 12. A plurality of conveyor rollers 16 are fixed to the upper follower shaft at suitable intervals, and correspondingly a plurality of conveyor rollers 18 are fixed to the lower driven shaft 14 at suitable intervals. The rollers 16 are located in notches formed in the downstream end of the upper guide plate 10, while the rollers 18 paired with the rollers 16 are located in notches formed in the downstream end of the lower guide plate 12. The upper follower shaft (not shown) is so mounted as to be vertically movable over some range, and the rollers 16 are pressed against the rollers 18 by their own weight. As shown in FIG. 2, an electric motor 20 is mounted on the front surface of the rear supporting side plate 6, and the output shaft of the motor 20 projects rearwards through the rear supporting side plate 6. The lower driven shaft 14 also projects rearwards through the rear supporting side plate 6, and the output shaft of the motor 20 is drivingly coupled to the lower driven shaft 14. Therefore, the pair of rollers 16 and 18 are rotatingly driven by the motor 20.

Figure 3:
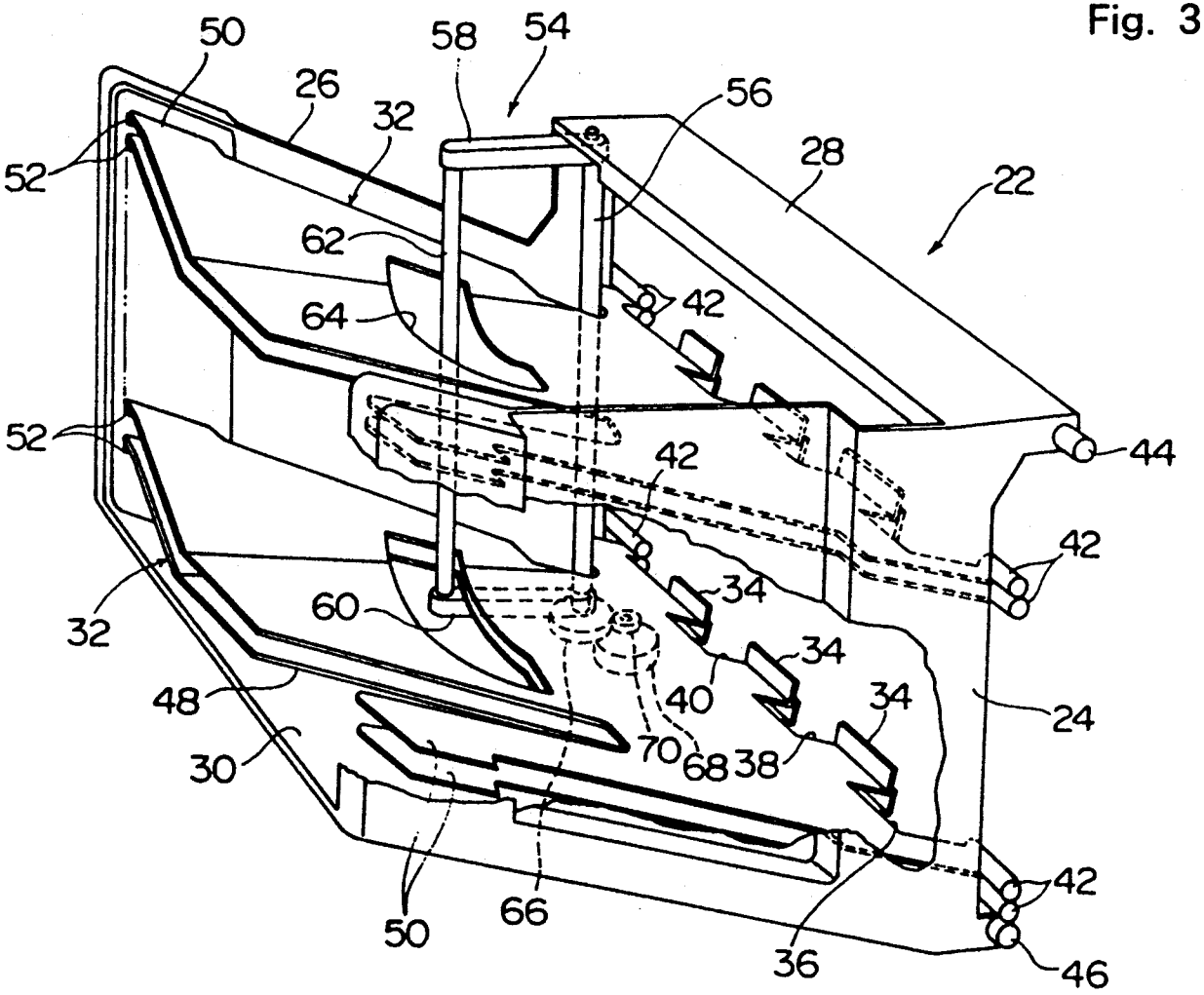
FIG. 3 is a partial perspective view showing a movable frame and bin trays mounted thereon, in the sorter of FIG. 1.
Figure 4:
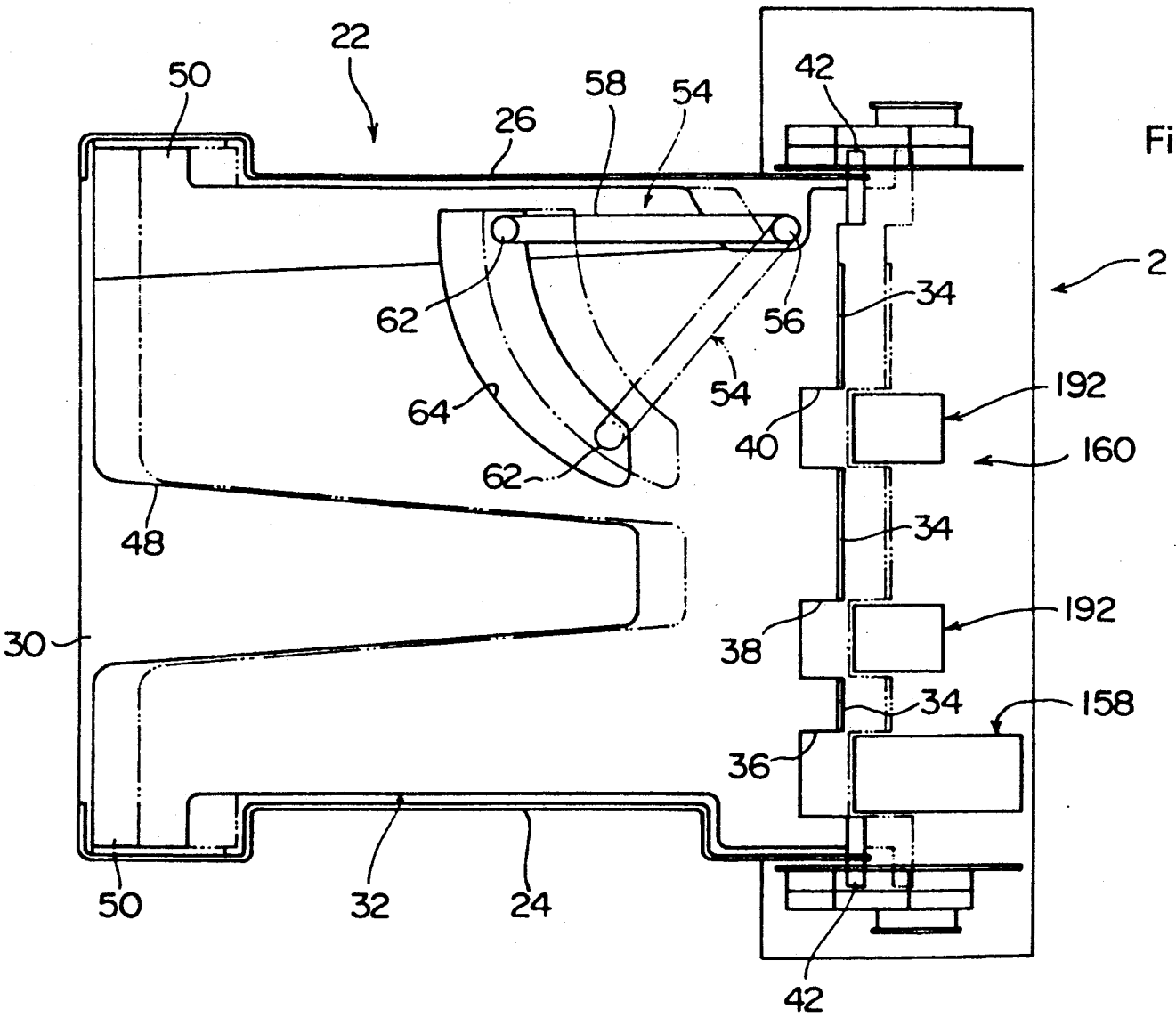
FIG. 4 is a transverse sectional view showing the bin tray, an automatic stapler and an automatic punch in the sorter of FIG. 1.

With reference to FIG. 3 along with FIG. 1, the illustrated sorter is provided with a movable frame 22 as well. The movable frame 22 has front and rear side surface walls 24 and 26 disposed in spaced relationship in the width direction, an upper surface wall 28 extending across the upstream upper ends of the front and rear side surface walls 24 and 26, and a lower surface wall 30 extending across the lower ends of the front and rear side surface walls 24 and 26. The movable frame 22 of this construction houses a plurality of (e.g. 20) bin trays 32 vertically arranged in a stacked condition. With reference to FIG. 4 along with FIGS. 1 and 3, each of the bin trays 32 is formed of a nearly rectangular plate-like member. At the upstream edge of each of the bin trays 32 (the right edge in FIG. 4) are formed three upwardly projecting stopping pieces 34 at intervals in the width direction. In the upstream end portion of each bin tray 32 are formed three rectangular notches 36, 38 and 40 adjoining the three stopping pieces 34. The both side portions of the upstream edge of each bin tray 32 are slightly protruded upstream, and trunnions 42 are fixed to these protruding end portions. The trunnion 42 which may be composed of a pin of a circular cross-sectional shape projects beyong the bin tray 32 outwardly in the width direction. As shown in FIG. 3, forwardly protruding portions are formed in the upper end portions of the upstream ends of the front and rear side surface walls 24 and 26 of the movable frame 22, and upper restraining pins 44 protruding outwardly in the width direction are fixed to the protruding portions. Likewise, forwardly protruding portions are formed in the lower end portions of the upstream ends of the front and rear side surface walls 24 and 26, and lower restraining pins 46 protruding outwardly in the width direction are fixed to the protruding portions. The trunnions 42 of the bin trays 32 are vertically arranged in a stacked condition, and are located between the upper restraining pin 44 and the lower restraining pin 46 (a detailed description of this arrangement will be given later). In the downstream half portion of each bin tray 32 is formed a relatively large elongate notch 48 of a trapezoidal shape. In both sides of the downstream end portion of each bin tray 32 are formed protruding portions 50 which protrude outwardly in the width direction. On the inside surfaces of the downstream end portions of the front and rear side surface walls 24 and 26 of the movable frame 22 are formed a plurality of (a number corresponding to the number of the bin trays 32; e.g. the number 20) supporting steps 52 at intervals vertically. The protruding portions 50 of the bin trays 32 are respectively supported on the supporting steps 52 of the movable frame 22, whereby the downstream end portions of the bin trays 32 are supported vertically at predetermined intervals. As will be seen clearly by reference to FIG. 1, each of the bin trays 32 extends, somewhat upwardly inclinedly, toward the downstream end.

With reference to FIGS. 3 and 4, a width-aligning means 54 is disposed in the rear portion of the upstream end of the movable frame 22. The illustrated width-aligning means 54 includes a rotating shaft 56 rotatably supported between the upper surface wall 28 and the lower surface wall 30 of the movable frame 22. To the upper end portion and the lower end portion of the rotating shaft 56 which extends substantially vertically are fixed arms 58 and 60 which extend substantially horizontally. Between the arms 58 and 60 is fixed a width-aligning rod 62. At a stated site of each bin tray 32 is formed an arcuately extending opening 64, through which the width-aligning rod 62 extends. To the lower end portion of the rotating shaft 56 is fixed an input gear 66. On the lower surface wall 30 of the movable frame 22 is mounted an electric motor 68 which conveniently is a stepping motor. An output gear 70 fixed to the output shaft of the motor 68 is in mesh with the input gear 66. Thus, the width-aligning rod 62 of the width-aligning means 54 is pivotally reciprocated by the motor 68 between a stand-by position shown by a solid line in FIG. 4 and the innermost position shown by a two-dot chain line in FIG. 4 or a required position advanced anteriorly of that position by a required angle (the angular position at the end point of the reciprocation of the width-aligning rod 62, i.e. the angular position at its turning point, is determined according to the width of the sheet collected on the bin tray 32).

With reference to FIG. 1 along with FIGS. 2 and 3, the movable frame 22 is mounted on the stationary supporting frame 2 by putting its upstream end portion between the front and rear upstanding supporting side plates 4 and 6. As clearly illustrated in FIGS. 1 and 2, a slit defining a trunnion guide passage 78 is formed in each of the supporting side plates 4 and 6 of the stationary supporting frame 2. The trunnion guide passage 78 has a main portion 80 which extends substantially vertically, and a by-pass portion 82 which extends upstream after abruptly changing its direction at a nearly middle portion in the vertical direction and then extends downstream after abruptly reversing its direction. As shown in FIG. 2, an elastic member 84, which acts on the trunnion 42 located at the by-pass end of the by-pass portion 82 of the trunnion guide passage 78, is mounted on the inside surface each of the supporting side plates 4 and 6. The elastic member 84 may be formed of a leaf spring. As will be understood by reference to FIGS. 1 and 3, not only the trunnion 42 of the bin tray 32 but also the upper restraining pin 44 and the lower restraining pin 46 fixed to the upper end portion and the lower end portion of the side surface walls 24 and 26 of the movable frame 22 are inserted into the trunnion guide passage 78, and caused to project outwardly in the width direction beyond the supporting side plates 4 and 6 through the trunnion guide passage 78.

Figure 5:
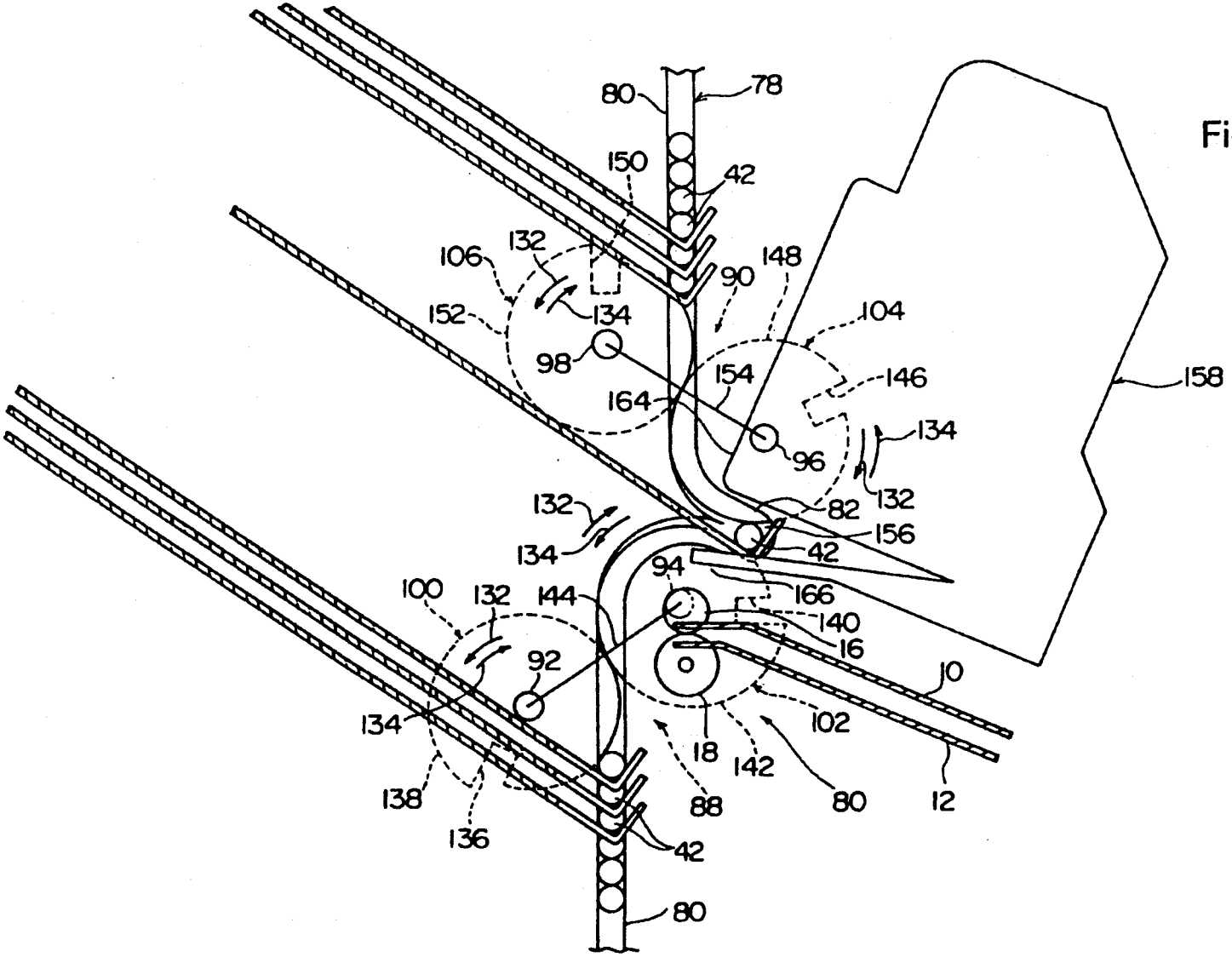
FIG. 5 is a partial longitudinal sectional view showing the relationship between a trunnion guide passage and the automatic stapler in the sorter of FIG. 1.

With reference to FIG. 5 along with FIGS. 1, 2 and 3, a transfer means 86 is disposed on the outside surface of each of the supporting side plates 4 and 6 of the stationary supporting frame 2. The illustrated transfer means 86 includes a first rotating cam plate pair 88 and a second rotating cam plate pair 90. More detailedly, short shafts 92, 94, 96 and 98 are fixedly mounted on the supporting side plates 4 and 6, and rotating cam plates 100, 102, 104 and 106 are respectively mounted rotatably on the short shafts 92, 94, 96 and 98. The rotating cam plates 100 and 102 constitute the first rotating cam plate pair 88, while the rotating cam plates 104 and 106 constitute the second rotating cam plate pair 90. As illustrated in FIG. 2, driving gears 108, 110, 112 and 114 are integrally provided on the rotating cam plates 100, 102, 104 and 106, respectively. The gear 108 and the gear 110 are in mesh with each other, while the gear 112 and the gear 114 are in mesh with each other. Pulleys 116 and 118 are further integrally provided on the rotating cam plates 102 and 104, and an endless belt 120 is wrapped round the pulleys 116 and 118. Furthermore, a transmission shaft 122 is rotatably mounted between the supporting side plates 4 and 6 of the stationary supporting frame 2. A driving gear 124 is fixed to the front end portion of the transmission shaft 122 which protrudes forwards through the supporting side plate 4, while a driving gear 126 is fixed to the rear end portion of the transmission shaft 122 which protrudes rearwards through the supporting side plate 6. The gear 124 is engaged with the gear 108 in the transfer means 86 disposed on the outside surface of the supporting side plate 4. Likewise, the gear 126 is engaged with the gear 108 in the transfer means 86 disposed on the outside surface of the supporting side plate 6. On the outside surface (the rear surface) of the supporting side plate 6 is mounted an electric motor 128 constituting a driving source for the transfer means 86. An output gear 130 fixed to the output shaft of the motor 128 is engaged with the gear 126. Therefore, when the motor 128 is normally rotated to rotate the transmission shaft 126 in a direction shown by an arrow 132, the rotating cam plates 100, 102, 104 and 106 are rotatingly driven in the direction shown by the arrow 132. When the motor 128 is reversely rotated to rotate the transmission shaft 126 in a direction shown by an arrow 134, the rotating cam plates 100, 102, 104 and 106 are rotatingly driven in the direction shown by the arrow 134. The rotating cam plates 100 and 102 which make a pair are always rotated in directions opposite to each other, and so are the rotating cam plates 104 and 106 which make a pair. The rotating cam plates 100 and 106 are always rotated in the same direction, and so are the rotating cam plates 102 and 104.

With reference to FIG. 5, a trunnion receiving groove 136 extending radially and being open at its radially outside end is formed in the rotating cam plate 100. The width of the trunnion receiving groove 136 corresponds to the diameter of the trunnion 42 of the bin tray 32. An outer circumferential cam surface 138 extending continuously in the circumferential direction excepting the site of the trunnion receiving groove 136 is a convoluted surface whose radius r progressively increases counterclockwise from one side of the trunnion receiving groove 136 to the other side thereof in FIG. 5. Conveniently, this convoluted surface is an Archimedian convoluted surface in which the ratio of the rotating angle 0 to the increase of the radius r is constant when viewed counterclockwise, and $r=a+n\theta$ where a is the minimum radius of the outer circumferential cam surface and n denotes a suitable constant. The difference (b-a) between the maximum radius b and the minimum radius a of the outer circumferential cam surface 138 corresponds to the diameter of the trunnion 42. The rotating cam plate 102 making a pair with the rotating cam plate 100 is of exactly the same shape as the rotating cam plate 100. Specifically, a trunnion receiving groove 140 extending radially and being open at its radially outside end is formed in the rotating cam plate 102. An outer circumferential cam surface 142 of the rotating cam plate 102 is an Archimedian convoluted surface whose radius r progressively increases from one side of the trunnion receiving groove 140 to the other side thereof when viewed counterclockwise. As clearly shown in FIG. 5, the rotating cam plate 100 and the rotating cam plate 102 are disposed on both sides of the main portion 80 located downward of the by-pass portion 82 in the trunnion guide passage 78. The central axis of rotation of the rotating cam plate 100 and the central axis of rotation of the rotating cam plate 102 are arranged deviatingly in the vertical direction, and a straight line 144 connecting both central axes obliquely crosses the main portion 80 of the trunnion guide passage 78 at an angle of inclination of, say, about 45 degrees. The rotating cam plates 100 and 102 rotated at substantially the same rotating speed in opposite directions to each other are disposed in a given angular relationship, more specifically, in such a manner that the trunnion receiving groove 136 and the trunnion receiving groove 140 face each other at a point where the straight line 144 connecting the central axes crosses the main portion 80 of the trunnion guide passage 78 as shown in FIG. 6-H. As will be seen easily by reference to FIGS. 6-G and 6-I along with FIG. 6-H, when the rotating cam plate 100 is rotated counterclockwise, and the rotating cam plate 102 clockwise, from the state shown in FIG. 6-H, the radius r of the outer circumferential cam surface 138 of the rotating cam plate 100 progressively decreases, and the radius r of the outer circumferential cam surface 142 of the rotating cam plate 102 progressively increases, at the above point of crossing. Conversely, when the rotating cam plate 100 is rotated clockwise, and the rotating cam plate 102 counterclockwise, from the state shown in FIG. 6-H, the radius r of the outer circumferential cam surface 138 of the rotating cam plate 100 progressively increases, and the radius r of the outer circumferential cam surface 142 of the rotating cam plate 102 progressively decreases, at the point of crossing. Therefore, the outer circumferential cam surface 138 of the rotating cam plate 100 and the outer circumferential cam surface 142 of the rotating cam plate 102 do not interfere with each other at the point of crossing, and the rotating cam plate 100 and the rotating cam plate 102 are always kept in contact, or in proximity, with each other at the point of crossing.

The construction for the rotating cam plates 104 and 106 which make a pair is substantially the same as the construction for the rotating cam plates 100 and 102 which make a pair. With reference to FIG. 5, a trunnion receiving groove 146 is formed in the rotating cam plate 104, and an outer circumferential cam surface 148 of the rotating cam plate 104 is an Archimedian convoluted surface whose radius r progressively increases from one side of the trunnion receiving groove 146 to the other side thereof when viewed clockwise. Likewise, a trunnion receiving groove 150 is formed in the rotating cam plate 106, and an outer circumferential cam surface 152 of the rotating cam plate 106 is an Archimedian convoluted surface whose radius r progressively increases from one side of the trunnion receiving groove 150 to the other side thereof when viewed clockwise. The rotating cam plate 104 and the rotating cam plate 106 are disposed on both sides of the main portion 80 which is located upward of the by-pass portion 82 in the trunnion guide passage 78. The central axis of rotation of the rotating cam plate 104 and the central axis of rotation of the rotating cam plate 106 are situated deviatingly in the vertical direction, and a straight line 154 connecting both central axes obliquely crosses the main portion 80 of the trunnion guide passage 78 an an angle of inclination which may be, say, about 45 degrees. The rotating cam plates 104 and 106 rotated at substantially the same speed and in opposite directions to each other are positioned at a predetermined angular relationship, more sepcifically, in such a manner that the trunnion receiving groove 146 and the trunnion receiving groove 150 face each other at a point where the straight line 154 connecting the rotating central axes crosses the main portion 80 of the trunnion guide passage 78, as shown in FIG. 6-E. As will be readily understood by reference to FIGS. 6-D and 6-F along with 6-E, when the rotating cam plate 104 is rotated clockwise, and the rotating cam plate 106 counterclockwise, from the state shown in FIG. 6-E, the radius r of the outer circumferential cam surface 148 of the rotating cam plate 104 progressively decreases, and the radius r of the outer circumferential surface 152 of the rotating cam plate 106 progressively increases, at the above point of crossing. Conversely, when the rotating cam plate 104 is rotated counterclockwise, and the rotating cam plate 106 clockwise, from the state shown in FIG. 6-E, the radius r of the outer circumferential cam surface 148 of the rotating cam plate 104 progressively increases, and the radius r of the outer circumferential surface 152 of the rotating cam plate 106 progressively decreases, at the above point of crossing. Therefore, the outer circumferential cam surface 148 of the rotating cam plate 104 and the outer circumferential cam surface 152 of the rotating cam plate 106 do not interfere with each other at the point of crossing, and the rotating cam plate 104 and the rotating cam plate 106 are always kept in contact, or in proximity, with each other at the point of crossing.

Furthermore, the rotating cam plate 102 and the rotating cam plate 104 face each other in a required relationship on both sides of the by-pass portion 82 of the trunnion guide passage 78, namely such that the outer circumferential cam surface 142 of the rotating cam plate 102 and the outer circumferential cam surface 148 of the rotating cam plate 104 lie in proximity to each other without interfering with each other. With reference to FIGS. 6-A through 6-L, the actions of the transfer means 86 will be briefly described as follows. When the transfer means 86 is stopped, the rotating cam plates 100, 102, 104 and 106 are stopped at angular positions shown in FIG. 6-A, and any one of the trunnions 42 of the plural bin trays 32 is positioned in the end portion of the by-pass portion 82, i.e. a by-pass end portion 156, of the trunnion guide passage 78. (The trunnion 42 positioned in the by-pass end portion 156 is brought into press contact with the outer circumferential surfaces 142 and 148 of the rotating cam plates 102 and 104 by the elastic member 84 shown in FIG. 2.) The other trunnions 42 are located downward or upward of the transfer means 86. FIGS. 6-A to 6-L illustrate the actions of the transfer means 86 taken when the rotating cam plates 100, 102, 104 and 106 are rotated in directions shown by the arrows 134 incident to the reverse rotation of the motor 128. As seen from FIGS. 6-C to 6-I, in particular, the lowermost trunnion 42 of the trunnions 42 positioned above the by-pass portion 82 is transferred to the by-pass end portion 156 by the action of the rotating cam plates 104 and 106. Also, the trunnion 42 that has been positioned in the by-pass end portion 156 is transferred to below the by-pass portion 82 by the action of the rotating cam plates 100 and 102. Conversely, when the rotating cam plates 100, 102, 104 and 106 are rotated in a direction shown by the arrow 132 incident to the normal rotation of the motor 128, the uppermost trunnion 42 of the trunnions 42 that has been positioned below the by-pass portion 82 is transferred to the by-pass end portion 156 by the action of the rotating cam plates 100 and 102. Simultaneously, the trunnion 42 which has been positioned in the by-pass end portion 156 is transferred to above the by-pass portion 82 by the action of the rotating cam plates 104 and 106. The trunnion transferring action of the rotating cam plates 100 and 102 and the trunnion transferring action of the rotating cam plates 104 and 106 are described in detail in the aforementioned U.S. Pat. No. 4,878,660 (Japanese Laid-Open Patent Publication No. 34865/1989), and descriptions of them are omitted in the specification of this application. With regard to the actions of the transfer means 86, the following facts should be noticed. In FIGS. 6-A to 6-L, the rotating cam plates 100 and 106 are rotated in the same direction, and the outer circumferential cam surface 138 of the rotating cam plate 100 has a radius progressively increasing counterclockwise, while the outer circumferential cam surface 152 of the rotating cam plate 106 has a radius progressively increasing clockwise. Therefore, when, for example, the transfer means 86 is rotated in the directions shown by the arrows 134 as shown in FIGS. 6-A to 6-L, the trunnions 42 situated below the by-pass portion 82 are gradually lowered incident to the clockwise rotation of the rotating cam plate 100, and the trunnion 42 is discharged downward from the trunnion receiving groove 136 of the rotating cam plate 100. The trunnions 42 situated above the by-pass portion 82 are gradually lowered incident to the clockwise rotation of the rotating cam plate 106, and are successively received into the trunnion receiving groove 150 of the rotating cam plate 106. Therefore, the plural trunnions 42 are gradually lowered without any impact involved. When the transfer means 86 is rotated in the reverse direction, too, a plurality of the trunnions 42 are likewise gradually elevated without any impact involved. In the illustrated embodiment, all the outer circumferential cam surfaces 138, 142, 148 and 152 of the four rotating cam plates 100, 102, 104 and 106 are of a convoluted shape. If desired, the outer circumferential cam surfaces 142 and 148 of the rotating cam plates 102 and 104 situated in the middle portion in the vertical direction may be of a circular shape (hence, the rotating cam plates 102 and 104 will be so-called Geneva rotating cam-type plates). In this case as well, the trunnions 42 can be lowered or elevated sufficiently smoothly (however, some impact may be generated when the trunnion 42 is transferred between the trunnion receiving groove 136 of the rotating cam plate 100 and the trunnion receiving groove 140 of the rotating cam plate 102, or when the trunnion 42 is transferred between the trunnion receiving groove 146 of the rotating cam plate 104 and the trunnion receiving groove 150 of the rotating cam plate 106).

Figure 7:
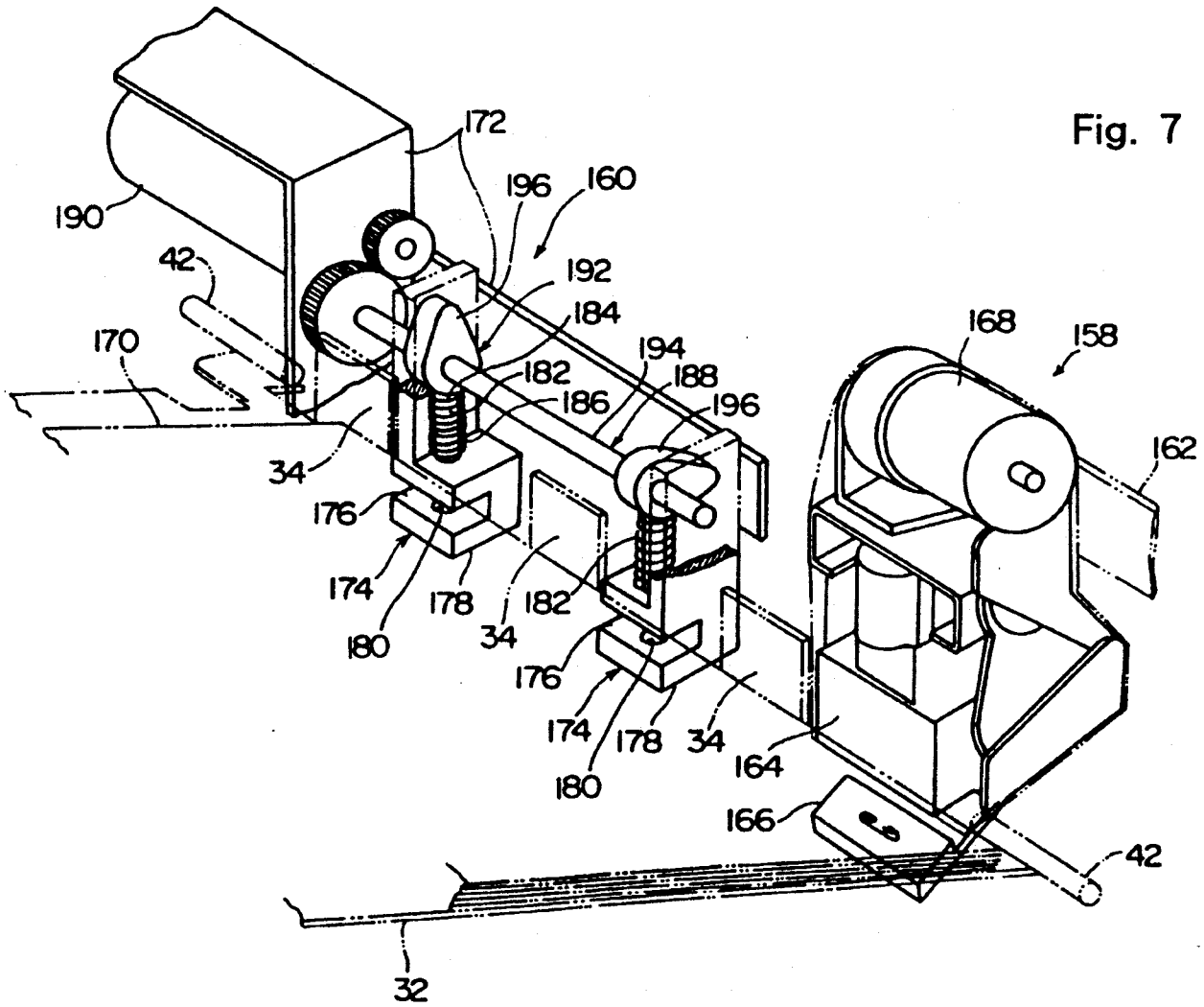
FIG. 7 is a partial perspective view showing the automatic stapler and the automatic punch in the sorter of FIG. 1.

With reference to FIG. 7 along with FIG. 2, in the illustrated sorter constructed in accordance with this invention, two kinds of automatic sheet-treating means, i.e. an automatic stapler indicated entirely at reference numeral 158 and an automatic punch shown entirely by reference numeral 160, are disposed between the supporting side plates 4 and 6 of the stationary supporting frame 2.

A connecting bracket 162 is fixed to the inside surface of the supporting side plate 4, and the automatic stapler 158 is mounted on the connecting bracket 162. As clearly illustrated in FIG. 5 together with FIG. 7, the automatic stapler 158 has an upper main portion 164 and a lower anvil 166. A driving source 168 which may be an electric motor is disposed in the automatic stapler 158. When the driving source 168 is energized in the condition where stacked sheets have been advanced into the space between the upper main portion 164 and the lower anvil 166, the stacked sheets are fastened together with staples. The automatic stapler 158 may be a commercially available product marketed, for example, under the trade name "Swing Line Zephyr." Hence, a description of the details of the construction of the automatic stapler 158 is omitted in the specification of this application. With reference to FIGS. 5 and 7, when the trunnion 42 of the particular bin tray 32 is transferred to the by-pass portion 82 via the main portion 80 of the trunnion guide passage 78 and situated in the by-pass end portion 156, this bin tray 32 is separated upwards from the bin tray 32 situated below it (and is separated downwards from the bin tray 32 situated above it), and also is displaced upstream with respect to the lower and upper bin trays 32. When the bin tray 32 is displaced to the upstream side, the bin tray 32 and a plurality of stacked sheets 170 collected thereon are situated at a required stapling position relative to the automatic stapler 158. More detailedly, when the bin tray 32 is displaced to the upstream side, the notch 36 formed in the upstream edge portion of the bin tray 32 is positioned in the space between the upper main portion 164 and the lower anvil 166 of the automatic stapler 158. Accordingly, those portions of the stacked sheets 170 which are situated in the notch 36 (i.e. one-cornered portions) are positioned in the space between the main portion 164 and the lower anvil 166 of the automatic stapler 158. Thus, when the driving source 168 of the automatic stapler 158 is energized, the one-cornered portions of the stacked sheets 170 on the bin tray 32 are fastened together with staples.

Figure 8:
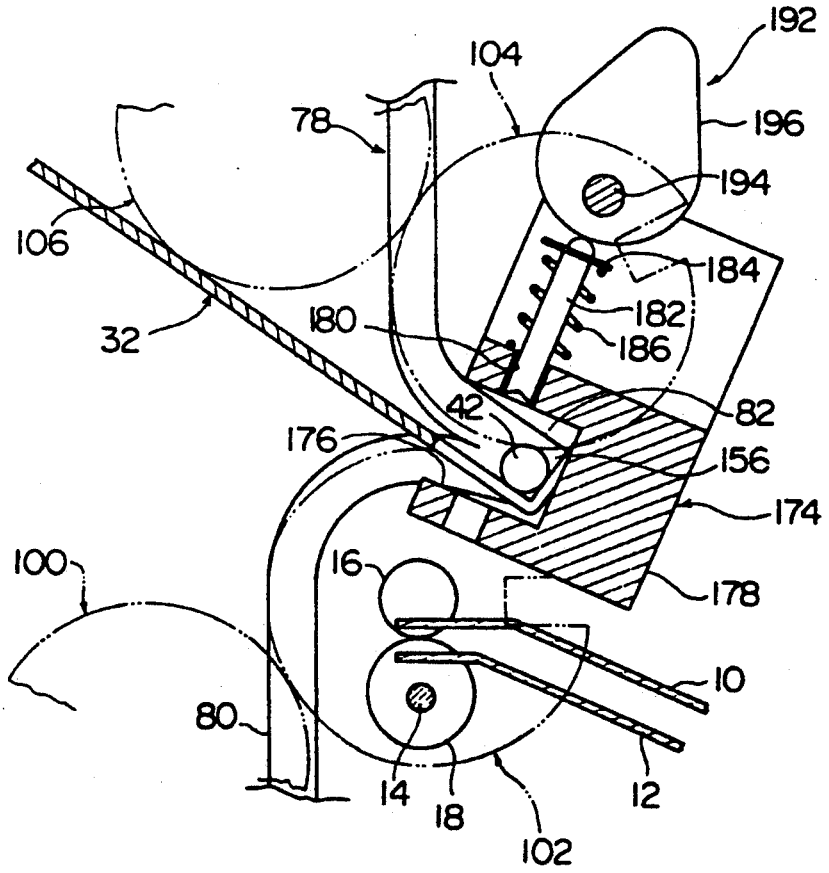
FIG. 8 is a partial longitudinal sectional view showing the relationship between the trunnion guide passage and the automatic punch in the sorter of FIG. 1.

With reference to FIGS. 2, 7 and 8, a connecting bracket 172 is fixed to the inside surface of the supporting side plate 6, and the automatic punch 160 is disposed on the connecting bracket 172. More specifically, the automatic punch 160 has a pair of punching portions 174 fixed to the connecting bracket 172 at a predetermined distance in the width direction. Each of the punching portions 174 includes a receiving block 178 in which a receiving opening 176 open in its downstream side is formed. In the receiving block 178 is formed a through-hole 180 extending vertically with respect to the receiving opening 176, and a punching member 182 is mounted slidably in the hole 180. The punching member 182 is caused to protrude upwards beyond the upper surface of the receiving block 178, and a stopping ring 184 is fixed to the upper end portion of the punching member 182. A coiled compression spring 186 is fitted around the punching member 182, and the coiled compression spring 186 is situated between the stopping ring 184 and the upper surface of the receiving block 178 to elastically bias the punching member 182 upwards. The automatic punch 160 further includes a driving mechanism 188. The driving mechanism is composed of a driving source 190 mounted on the connecting bracket 172 and a cam means 192. The driving source 190 may be a suitable electric motor. The cam means 192 has a rotating shaft 194 which is mounted rotatably, and two eccentric cams 196 fixed to the rotating shaft 194. The two eccentric cams 196 act on the respective punching members 182 of the two punching portions 174. The rotating shaft 194 is drivingly connected to the driving source 190 via driving gears 198 and 200. When the driving source 190 is deenergized, the punching member 182 in each of the punching portions 174 is held at a retreated position shown in FIG. 8 by the biasing action of the spring 186. When the driving source 190 is energized, the rotating shaft 194 makes one rotation. By the action of the eccentric cam 196, the punching member 182 is lowered through the receiving opening 176, and then elevated to the original position. Hence, when the sheets 170 are advanced into the receiving opening 176, the sheets 170 are punched. The two eccentric cams 196 which perform a punching action by lowering the punching members 182 should desirably have angular positions deviating from each other so that the punching action of one of the punching members 182 and the punching action of the other punching member 182 are performed not simultaneously but sequentially to avoid a transient excessive load of driving. As will be clearly understood by reference to FIG. 7 and 8, when the trunnion 42 of a particular bin tray 32 is transferred to the by-pass portion 82 via the main portion of the trunnion guide passage 78 and positioned in the by-pass end portion 156 and so the bin tray 32 is displaced to the upstream side, the bin tray 32 and the sheets 170 collected thereon are positioned at a required stapling position relative to the automatic stapler 158; in addition, the bin tray 32 and the sheets 170 collected thereon are positioned at a required punching position relative to the automatic punch 160. In more detail, when the bin tray 32 is displaced to the upstream side, the notches 38 and 40 (FIGS. 3 and 4) formed in the upstream edge portions of the bin tray 32 are positioned, respectively, in the receiving openings 176 of the two punching portions 182; accordingly, the required marginal sites of the sheets 170 on the bin tray 32 are advanced into the receiving openings 176 of the two punching portions 182. Hence, when the driving source 190 of the automatic punch 160 is energized, the required marginal sites of the sheets 170 are punched.

Next, the actions of the sorter as described above will be summarized below.

Figure 10:
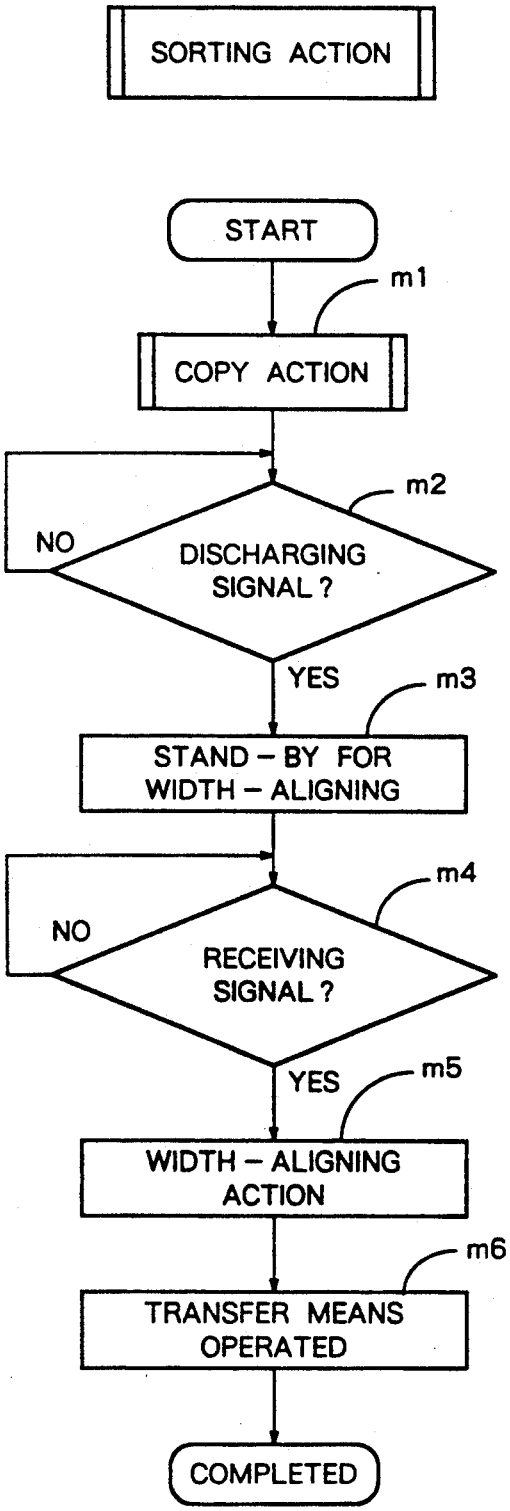
Figure 11:
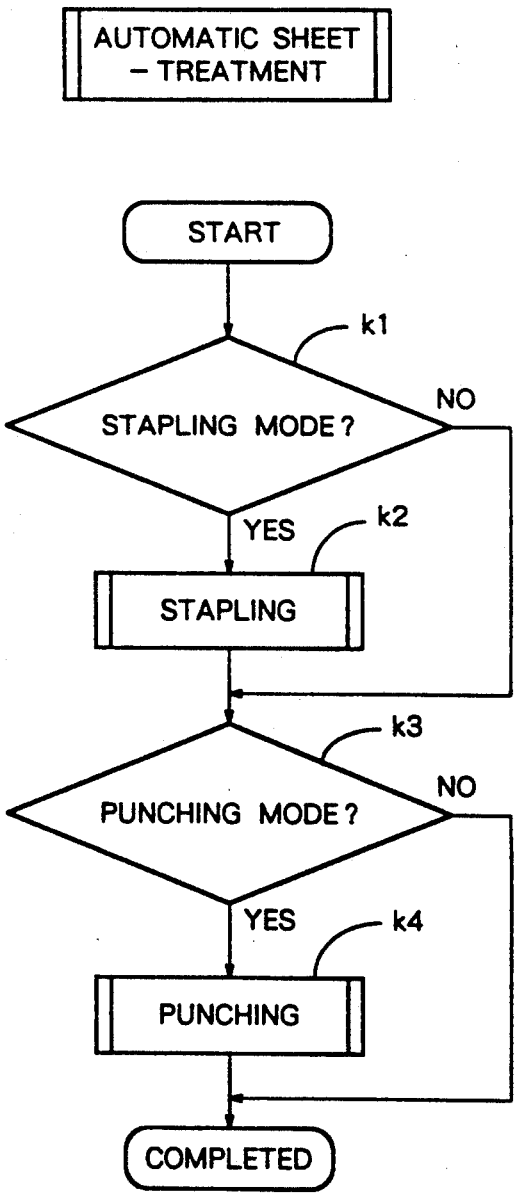

The illustrated sorter is used, for example, as a part provided in an electrostatic copying machine. In this case, the sorter is combined with the copying machine so that sheets being discharged from the housing (not shown) of the copying machine after having a required copied image formed thereon are guided through the space between the upper guide plate 10 and the lower guide plate 12 in the sorter. The actions of the copying machine and the sorter combined therewith are controlled in the followng manner by a controlling means which may be comprised of a microprocessor. With reference to FIGS. 9A and 9B along with FIG. 1, when an operation is started by pressing a starting switch for copying (not shown), it is judged at step n1 whether an automatic sheet-treating mode has been selected or not (i.e. whether an automatic stapling mode or an automatic punching mode has been selected or not). When the automatic sheet-treating mode has not been selected, the procedure proceeds to step n2 in which the ordinary action is performed. The action of the sorter during this ordinary action is substantially the same as that of a conventional sorter which is not equipped with an automatic sheet-treating means (i.e. the automatic stapler 158 and the automatic punch 160). When the automatic sheet-treating mode has been selected in the step n1, the procedure proceeds to step n3, where it is judged whether a sorting mode has been selected or not. When the sorting mode has been selected, the procedure proceeds to step n4 in which a sorting action is performed. During this sorting action, a copying action of the copying machine is performed at step ml, as illustrated in FIG. 10. Then, the procedure proceeds to step m2 where it is judged whether a discharging signal showing the discharge of a sheet from the copying machine has been made or not. When the discharging signal has been produced, the procedure proceeds to step m3, in which the width-aligning rod 62 of the width-aligning means 54 in the sorter is returned from the predetermined width-aligning position to the stand-by position shown by the solid line in FIG. 4. Then, the procedure proceeds to the step m4, in which it is judged whether a receiving signal showing the reception of the sheet onto a given bin tray 32 of the sorter has been produced or not. It is possible, for example, to dispose a detecting switch (not shown) in proximity to the pair of conveyor rollers 16 and 18 in the sorter so that the receiving signal may be made when the sheet passes by the detecting switch. When the receiving signal is produced, the procedure proceeds to step m5, in which the width-aligning rod 62 of the width-aligning means 54 is pivoted counterclockwise to a required width-aligning position in FIG. 4 (the width-aligning position of the width-aligning rod 62 is determined according to the width of the sheet). Then, the procedure proceeds to step m6 where the transfer means 86 is operated, whereby the rotating cam plates 100, 102, 104 and 106 are caused to make one rotation in required directions, and the bin trays 32 are transferred. The transfer of the bin trays 32 which is performed successively in response to the reception of sheets is designed to successively move the trunnions 42 either from below the by-pass portion 82 to above the by-pass portion 82 via the by-pass end portion 156, or from above the by-pass portion 82 to below the by-pass portion 82 via the by-pass end portion 156. This transfer action is different from the ordinary transfer of bin trays in that the trunnions 42 are once stopped in the by-pass end portion 156. When the trunnion 42 of the bin tray 32 is positioned in the by-pass end portion 156, the bin tray 32 and the sheets received thereon are positioned at a required treating position, i.e. a stapling position and a punching position, relative to the automatic stapler 158 and the automatic punch 160, as mentioned previously. When the trunnion 42 is to be positioned to the by-pass end portion 156, the bin tray 32 is moved in a by-passing manner to the upstream side, and when the trunnion 42 is to be moved from the by-pass end portion 156, the bin tray 32 is moved in a returning manner to the downstream side. Therefore, the bin tray 32 is transferred, as required, without undergoing interference by the automatic stapler 158 and the automatic punch 160 (see FIGS. 5 and 8). When the above-described sorting action is completed, the procedure proceeds to step n5 in FIG. 9A, where it is judged whether a predetermined number of copying actions (i.e. copying actions for a predetermined number of copies and a predetermined number of sets of copies) have been completed or not. When the predetermined number of copying actions have been completed, the procedure proceeds to step n6 for the execution of automatic sheet-treatment. At this automatic sheet-treatment, it is judged whether an automatic stapling mode has been selected at step k1, as illustrated in FIG. 11. When the automatic stapling mode has been selected, the procedure advances to step k2 where the automatic stapler 160 is caused to act on stacked sheets 170 (FIG. 7) received on the bin tray 32 whose trunnion 42 has been positioned in the by-pass end portion 156. As a result, the sheets 170 are fastened together with staples. Then, the procedure advances to step k3 for judgment of whether an automatic punching mode has been selected or not. When the automatic punching mode has been selected, the procedure moves on to step k4. At this step, the automatic punch 160 is caused to act on sheets 170 (FIG. 7) received on the bin tray 32 whose trunnion 42 has been positioned in the by-pass end portion 156, whereby required sites of the sheets 170 are punched. The action of the automatic stapler 158 in step k2 and the action of the automatic punch 160 in step k4 can be performed simultaneously, but the sequential execution of these actions as in the illustrated embodiment can avoid an electric overload which would occur upon their simultaneous action. Moreover, when a plurality of sheets are stacked, punching after stapling involves a lower risk of punched hole misalignment. When the automatic sheet-treatment described above is completed, the procedure proceeds to step n7 in FIG. 9A to judge whether or not the automatic sheet-treatment has been performed for all the bin trays 32 on which sheets 170 have been received. When the automatic sheet-treatment has not been performed for all of the bin trays 32, the procedure goes to step n8. At this step, the transfer means 86 is operated to cause the rotating cam plates 100, 102, 104 and 106 to make one rotation in required directions, whereby the trunnion 42 of the bin tray 32 immediately below or above the bin tray 32 having undergone the automatic sheet-treatment is positioned to the by-pass end portion 156. Then, the step n6 is resumed to perform automatic sheet-treatment. When automatic sheet-treatment has been performed at the step n7 in regard to all of the bin trays 32, the procedure moves to step n9 to judge whether or not the predetermined number of sets of copies obtained at the step n5 is the same as the desired number of sets of copies, namely whether all the desired copying actions have been completed or not. When the desired number of sets of copies is larger than the number of the bin trays 32, and all of the desired copying actions have not been completed, the procedure moves to step n10 to judge whether sheets 170 have been recovered manually from the bin trays 32. This judgment can be performed according to the output of the detecting switch (not shown) which detects whether sheets are present on each of the bin trays 32. When the sheets have been recovered from the bin trays 32, the step n4 is resumed to repeat a sorting action.

When a so-called group mode, rather than a sorting mode, has been selected at the step n3, the procedure goes to step n11 to perform a copying action. During this copying action, a plurality of the bin trays 32, for instance, are all situated to below the transfer means 86 in the sorter (accordingly, the trunnion 42 of the uppermost bin tray 32 is pressed against the outer circumferential cam surface 138 of the rotating cam plate 100). Therefore, sheets discharged from the copying machine are collected on the uppermost bin tray 32. Then, the procedure advances to step n12 to judge whether a required number of sheets have been collected on the uppermost bin tray 32. When the required number of sheets have been collected on the uppermost bin tray 32, the procedure goes to step n13 to operate the transfer means 86. As a result, the trunnion 42 of the uppermost bin tray 32 is positioned in the by-pass end portion 156, whereby the uppermost bin tray 32 is positioned at a required treating position, i.e. a stapling position and a punching position, relative to the automatic stapler 158 and the automatic punch 160. Then, the procedure proceeds to step n14 to carry out the same automatic sheet-treatment as done in the step n6. Thereafter, the procedure goes to step n15 to judge whether the desired copying actions have all been completed or not. When the group mode has been selected, necessitating that after the collection of a required number of sheets on the uppermost bin tray 32, a required number of sheets should be collected successively on the lower bin trays from above, the step n11 is resumed to perform the ordinary action for the next bin tray. The automatic sheet-treatment may be performed after all of the grouping action is completed. However, when the bin tray 32 is moved upwards, it is positioned at a required untreated position; therefore, the automatic sheet-treatment should preferably be carried out whenever each bin tray 32 is moved. Since the bin tray 32 onto which sheets are to be discharged and the bin tray 32 positioned at the untreated position are different, automatic treatment can be applied to sheets on the preceding bin tray 32 while sheets are being discharged on the following bin tray 32.

While an embodiment of a sorter constructed in accordance with this invention has been described in detail with reference to the accompanying drawings, it should be understood that the invention is not limited to this embodiment, but various changes and modifications are possible without departing from the scope of the invention described and claimed therein.

For instance, the illustrated embodiment has an automatic stapler and an automatic punch disposed in conjunction with the upstream end portion of the bin tray. If desired, however, the automatic stapler and the automatic punch may be disposed in connection to the downstream end portion of the bin tray. In this case, each of the bin trays is arranged downwardly inclinedly toward the downstream side, so that the downstream ends of sheets collected on the bin trays are aligned with the downstream ends of the bin trays. Furthermore, when the bin tray is to be positioned at an automatic sheet-treating position (i.e. a stapling position and a punching position), the bin tray is moved in a by-passing manner to the downstream side, rather than the upstream side. When the bin tray is returned from the automatic sheet-treating position, it needs to be moved to the upstream side.

In conclusion, this invention achieves, for example, the following excellent effects:

(1) The construction for an automatic sheet-treating means, such as an automatic stapler or an automatic punch, can be made markedly simple and inexpensive as compared with conventional sorters.

(2) Required treatments can be applied to sheets without needing a special treating time added to the necessary time for an ordinary sorting action.

(3) Sheets can be automatically punched as desired.

What I claim is:

1. A sorter provided with a plurality of vertically arranged bin trays, the bin trays respectively having a widthwise projecting trunnion in at least one side thereof, a supporting frame having formed therein a trunnion guide passage which defines a moving passage for the trunnions, a transfer mechanism for moving the trunnions successively one by one through the moving passage and spacing adjacent bin trays from each other successively vertically at their upstream ends to form a sheet receiving opening between them, the transfer mechanism being composed of a cam means including two pairs of rotating cam plates which are vertically arranged and a driving means for driving the cam means, at least the uppermost and lowermost rotating cam plates of each of the two pairs of rotating cam plates respectively having at least one trunnion receiving groove extending radially and being open at its radially outside end and an outer circumferential cam surface extending continuously in the circumferential direction excepting a site corresponding to the trunnion receiving groove, the outer circumferential cam surface being a convoluted surface whose radius increases progressively in a given rotating direction, the uppermost rotating cam plate and the lowermost rotating cam plate being rotated synchronously in opposite directions to each other so that the vertical cam lengths defined by their outer circumferential cam surfaces may be constant; wherein the moving passage for the trunnions includes a main portion and a by-pass portion detouring upstream or downstream from the main portion, each pair of the rotating cam plates are arranged such that a straight line connecting their rotating central axes crosses the moving passage for the trunnions and that the rotating cam plates making the pair move toward or away from each other at a part at which the straight line connecting their rotating central axes crosses the moving passage for the trunnions, when the trunnion of each of the bin trays is moved along the main portion and the by-pass portion, each of the bin trays and sheets collected thereon are caused to move 2. A sorter provided with a plurality of vertically arranged bin trays, the bin trays respectively having a widthwise projecting trunnion in at least one side thereof, a supporting frame having formed therein a trunnion guide passage which defines a moving passage for the trunnions, a transfer mechanism for moving the trunnions successively one by one through the moving passage and spacing adjacent bin trays from each other successively vertically at their upstream ends to form a sheet receiving opening between them, and automatic sheet-treating means for acting on sheets collected in the bin, the transfer mechanism being composed of a cam means including two pairs of rotating cam plates which are vertically arranged and a driving means for driving the cam means, at least the uppermost and lowermost rotating cam plates of each of the two pairs of rotating cam plates respectively having at least one trunnion receiving groove extending radially and being open at its radially outside end and an outer circumferential cam surface extending continuously in the circumferential direction excepting a site corresponding to the trunnion receiving groove, the outer circumferential cam surface being a convoluted surface whose radius increases progressively in a given rotating direction, the uppermost rotating cam plate and the lowermost rotating cam plate being rotated synchronously in opposite directions to each other so that the vertical cam lengths defined by their outer circumferential cam surfaces may be constant; wherein the moving passage for the trunnions includes a main portion and a by-pass portion detouring upstream or downstream from the main portion, each pair of the rotating cam plates are arranged such that a straight line connecting their rotating central axes crosses the moving passage for the trunnions and that the rotating cam plates making the pair move toward or away from each other at a part at which the straight line connecting their rotating central axes crosses the moving passage for the trunnions, when the trunnion of each of the bin trays is moved along the main portion and the by-pass portion, each of the bin trays and sheets collected thereon are caused to move without undergoing interference from the automatic sheet-treating means, and when the trunnion of each of the bin trays is positioned in the by-pass end portion of the by-pass portion, sheets collected on each of the bin trays are situated at a required treating position relating to the automatic sheet-treating means.

3. A sorter provided with a plurality of vertically arranged bin trays, the bin trays respectively having a widthwise projecting trunnion in at least one side thereof, a supporting frame having formed therein a trunnion guide passage which defines a moving passage for the trunnions, a transfer mechanism for moving the trunnions successively one by one through the moving passage and spacing adjacent bin trays from each other successively vertically at their upstream ends to form a sheet receiving opening between them, and an automatic stapler for fastening together a plurality of stacked sheets collected on the bin tray, the transfer mechanism being composed of a cam means including two pairs of rotating cam plates which are vertically arranged and a driving means for driving the cam means, at least the uppermost and lowermost rotating cam plates of each of the two pairs of rotating cam plates respectively having at least one trunnion receiving groove extending radially and being open at its radially outside end and an outer circumferential cam surface extending continuously in the circumferential direction excepting a site corresponding to the trunnion receiving groove, the outer circumferential cam surface being a convoluted surface whose radius increases progressively in a given rotating direction, the uppermost rotating cam plate and the lowermost rotating cam plate being rotated synchronously in opposite directions to each other so that the vertical cam lengths defined by their outer circumferential cam surfaces may be constant; wherein the moving passage for the trunnions includes a main portion and a by-pass portion detouring upstream or downstream from the main portion, each pair of the rotating cam plates are arranged such that a straight line connecting their rotating central axes crosses the moving passage for the trunnions and that the rotating cam plates making the pair move toward or away from each other at a part at which the straight line connecting their rotating central axes crosses the moving passage for the trunnions, when the trunnion of each of the bin trays is moved along the main portion and the by-pass portion, each of the bin trays and sheets collected thereon are caused to move without undergoing interference by the automatic stapler, and when the trunnion of each of the bin trays is positioned in the by-pass end portion of the by-pass portion, sheets collected on each of the bin trays are situated at a required stapling position relative to the automatic stapler.

4. A sorter provided with a plurality of vertically arranged bin trays, the bin trays respectively having a widthwise projecting trunnion in at least one side thereof, a supporting frame having formed therein a trunnion guide passage which defines a moving passage for the trunnions, a transfer mechanism for moving the trunnions successively one by one through the moving passage and spacing adjacent bin trays from each other successively vertically at their upstream ends to form a sheet receiving opening between them, and an automatic punch for punching sheets collected on the bin tray, the transfer mechanism being composed of a cam means including two pairs of rotating cam plates which are vertically arranged and a driving means for driving the cam means, at least the uppermost and lowermost rotating cam plates of each of the two pairs of rotating cam plates respectively having at least one trunnion receiving groove extending radially and being open at its radially outside end and an outer circumferential cam surface extending continuously in the circumferential direction excepting a site corresponding to the trunnion receiving groove, the outer circumferential cam surface being a convoluted surface whose radius increases progressively in a given rotating direction, the uppermost rotating arm plate and the lowermost rotating cam plate being rotated synchronously in opposite directions to each other so that the vertical cam lengths defined by their outer circumferential cam surfaces may be constant: wherein the moving passage for the trunnions includes a main portion and a bypass portion detouring upstream or downstream from the main portion, each pair of the rotating cam plates are arranged such that a straight line connecting their rotating central axes crosses the moving passage for the trunnions and that the rotating cam plates making the pair move toward or away from each other at a part at which the straight line connecting their rotating central axes crosses the moving passage for the trunnions, when the trunnion of each of the bin trays is moved along the main portion and the by-pass portion, each of the bin trays and sheets collected thereon are caused to move without undergoing interference from the automatic punch, and when the trunnion of each of the bin trays is positioned in the by-pass end portion of the by-pass portion, sheets collected on each of the bin trays are situated at a required punching position relative to the automatic punch.

* * * * *